US010774783B2

(12) United States Patent
Goyette

(10) Patent No.: US 10,774,783 B2
(45) Date of Patent: Sep. 15, 2020

(54) LIQUID PISTON STIRLING ENGINE WITH LINEAR GENERATOR

(71) Applicant: Donald Goyette, Bolivar, MO (US)

(72) Inventor: Donald Goyette, Bolivar, MO (US)

(73) Assignee: STRATUM VENTURES, LLC, Canton, GA (US)

( * ) Notice: Subject to any disclaimer, the term of this patent is extended or adjusted under 35 U.S.C. 154(b) by 0 days.

(21) Appl. No.: 16/390,725

(22) Filed: Apr. 22, 2019

(65) Prior Publication Data

US 2019/0323451 A1 Oct. 24, 2019

Related U.S. Application Data

(60) Provisional application No. 62/660,352, filed on Apr. 20, 2018.

(51) Int. Cl.
*F02G 1/053* (2006.01)

(52) U.S. Cl.
CPC ..... *F02G 1/053* (2013.01); *F02G 2243/36* (2013.01); *F02G 2270/30* (2013.01)

(58) Field of Classification Search
CPC .. F02G 1/053; F02G 2243/36; F02G 2270/30; F02G 2270/70; F02G 2280/10; F02G 1/0435
See application file for complete search history.

(56) References Cited

U.S. PATENT DOCUMENTS

| | | | | |
|---|---|---|---|---|
| RE30,894 | E * | 4/1982 | Schuman | F01B 11/00 60/520 |
| 4,429,530 | A * | 2/1984 | Beale | F02G 1/0435 60/520 |
| 5,329,768 | A * | 7/1994 | Moscrip | F02G 1/0435 60/518 |
| 5,901,556 | A * | 5/1999 | Hofler | F03G 7/002 62/467 |
| 6,701,708 | B2 | 3/2004 | Gross et al. | |
| 7,677,039 | B1 | 3/2010 | Fleck | |
| 8,495,873 | B2 | 7/2013 | Foster | |
| 2005/0072148 | A1* | 4/2005 | Francois | F02G 1/0435 60/516 |
| 2012/0125001 | A1* | 5/2012 | Ittner | F02G 1/0435 60/641.15 |
| 2018/0087473 | A1* | 3/2018 | Bertschi | F02G 1/0435 |

* cited by examiner

*Primary Examiner* — Jesse S Bogue
(74) *Attorney, Agent, or Firm* — Thomas C. Saitta

(57) ABSTRACT

A liquid piston Stirling engine electrical generator, the generator being a linearly reciprocating electrical generator that is powered by a Stirling engine having a liquid piston that is displaced by the cyclic contraction and expansion of a gas resulting from increases and decreases in temperature. The liquid piston and dynamic components of the linear generator are retained within a U-shaped tube or chamber, the tube being oriented in use to consist of a two upwardly extending, first and second vertical segments joining a horizontal segment. A liquid, such as oil or hydraulic fluid, is present in sufficient quantity to fill the horizontal segment and extend upward into the vertical segments.

16 Claims, 2 Drawing Sheets

LIQUID PISTON STIRLING ENGINE WITH LINEAR GENERATOR

BACKGROUND OF THE INVENTION

This application relates generally to the field of electrical power generation and more particularly to electrical generation by Stirling engines. Even more particularly, the application relates to Stirling engines driving a liquid piston and electrical generation by reciprocal linear motion of magnets within a static coil.

Stirling engines in various embodiments are well known and can be generally described in their most common form as a heat engine that operates by cyclic expansion and contraction of a gas, often referred as the working fluid, at different temperatures. A Stirling engine is a thermo-dynamic, closed-cycle, regenerative heat engine wherein the gaseous working fluid is permanently retained within the system. An internal heat exchanger and thermal store, known as a regenerator, differentiates the Stirling engine from other closed cycle hot air engines.

Common Stirling engines suffer from problems relating to friction and wear, as moving seals are subject to degradation and failure over time. It is an object of this invention to provide a novel Stirling engine electrical generator that does not suffer the friction and wear problems found in other Stirling engines.

SUMMARY OF THE INVENTION

The invention in various embodiments comprises in general a liquid piston Stirling engine electrical generator, the generator being a linearly reciprocating electrical generator that is powered by a Stirling engine having a contained liquid, i.e., the liquid piston, that is displaced by the cyclic expansion and contraction of a gas, such as air, due to cyclic increases and decreases in the temperature of the gas. The liquid piston and some components of the linear generator are retained within a generally U-shaped tube or chamber, the tube being oriented to consist of two upwardly extending, first and second vertical segments joined by a horizontal segment. An essentially non-compressible liquid, such as oil or hydraulic fluid, forms the liquid piston and is present in sufficient quantity to fill the horizontal segment and extend upward into the vertical segments.

The cycle head of a Stirling engine is located on the upper end of the first vertical segment and retains a first volume of gas, the cycle head comprising a hot side heat exchanger structured to transfer heat energy to a gas occupying open areas within the hot side heat exchanger, a cold side heat exchanger structured to remove energy from s gas occupying open areas within the cold side heat exchanger, a displacer adapted to move the first volume of gas between the hot and cold side heat exchangers, a thermal barrier between the hot and cold side heat exchangers to prevent direct heat transfer from the hot side heat exchanger to the cold side heat exchanger, and a motor to move the displacer. Such Stirling engines are well known. The displacer may for example be a rotary displacer or a piston displacer. A high-pressure gas chamber is located at the upper end of the second vertical segment and contains a second volume of gas, the chamber acting as a gas spring relative to movement of the liquid within the U-shaped chamber. The first volume gas and the second volume gas are separated by the liquid piston.

Certain dynamic components of the linear generator reside in the horizontal segment of the U-shaped chamber and other static components are external to the horizontal segment of the U-shaped chamber. The linear generator comprises a translating slider on which are mounted permanent magnets, the slider moving within a stator that is preferably defined by the horizontal segment of the U-shaped chamber, the stator having a plurality of wire coils annularly disposed thereon. Reciprocating linear movement of the magnets on the slider within the wire coils of the stator generates an electrical current. The movement of the slider is caused by the expansion and contraction cycling of the first volume gas by the Stirling cycle head in combination with the compression and expansion cycling of the second volume gas within the gas spring chamber.

In alternative summarization, the invention is a liquid piston Stirling engine linear generator device comprising: a U-shaped chamber having a first vertical segment and a second vertical segment joined by a horizontal segment; a liquid piston comprising a liquid occupying said horizontal segment, a portion of said first vertical segment and a portion of said second vertical segment; a cycle head of a Stirling engine connected to and in fluid communication with said first vertical segment; a gas spring chamber connected to and in fluid communication with said second vertical segment; a first volume gas occupying said cycle head and in contact with said liquid occupying said first vertical segment, and a second volume gas occupying said gas spring chamber and in contact with said liquid occupying said second vertical segment; a slider disposed within said horizontal segment, said slider able to move in reciprocating manner within said horizontal segment; magnets disposed on said slider; and a stator comprising wire coils annularly encircling said horizontal segment; whereby expansion and contraction of said first volume gas upon operation of said cycle head results in reciprocal movement of said slider relative to said wire coils such that electrical current is generated. Furthermore, said slider having a transverse cross-sectional configuration and said horizontal segment having a transverse cross-sectional configuration, wherein said slider transverse cross-sectional configuration corresponds to said horizontal segment transverse cross-sectional configuration; wherein said slider transverse cross-sectional configuration and said horizontal segment transverse cross-sectional configuration preclude rotational movement of said slider within said horizontal segment; wherein said slider comprises a bridging member connecting two lobes to form a pair of channels, and wherein said magnets are disposed within said channels; wherein said liquid is chosen from the group of liquids consisting of hydraulic fluid and oil; wherein said cycle head comprises a rotary displacer; wherein said slider is disposed within said liquid piston; wherein said stator is disposed on said horizontal segment; and/or wherein said stator is comprised of a portion of said horizontal segment.

Alternatively, the invention is a liquid piston Stirling engine linear generator device comprising: a U-shaped chamber having a first vertical segment and a second vertical segment joined by a horizontal segment, said U-shaped chamber structured to retain a liquid; a liquid piston comprising an essentially non-compressible liquid occupying said horizontal segment, a portion of said first vertical segment and a portion of said second vertical segment; a cycle head of a Stirling engine connected to and in fluid communication with said first vertical segment, said cycle head comprising a hot side heat exchanger, a cold side heat exchanger and a displacer; a gas spring chamber connected to and in fluid communication with said second vertical segment; a first volume gas occupying said cycle head and in contact with said liquid occupying said first vertical segment, and a second volume gas occupying said gas spring chamber and in contact with said liquid occupying said second vertical segment; slider disposed within said horizontal segment and within said liquid piston, said slider retaining magnets and able to move in reciprocating manner within said horizontal segment; and a stator disposed on or formed as part of said horizontal segment, said stator comprising wire coils annularly encircling said horizontal segment and surrounding said slider; said slider having a transverse cross-sectional configuration and said horizontal segment having a transverse cross-sectional configuration, wherein said slider transverse cross-sectional configuration corresponds to said horizontal segment transverse cross-sectional configuration; whereby expansion and contraction of said first volume gas upon operation of said cycle head results in reciprocal movement of said liquid piston within said U-shaped chamber and reciprocal movement of said slider relative to said wire coils such that electrical current is generated. Furthermore, wherein said slider transverse cross-sectional configuration and said horizontal segment transverse cross-sectional configuration preclude rotational movement of said slider within said horizontal segment; wherein said slider comprises a bridging member connecting two lobes to form a pair of channels, and wherein said magnets are disposed within said channels; wherein said liquid is chosen from the group of liquids consisting of hydraulic fluid and oil; wherein said cycle head comprises a rotary displacer; wherein said stator is disposed on said horizontal segment; and/or wherein said stator is comprised of a portion of said horizontal segment.

DETAILED DESCRIPTION OF THE INVENTION

Figure 1:
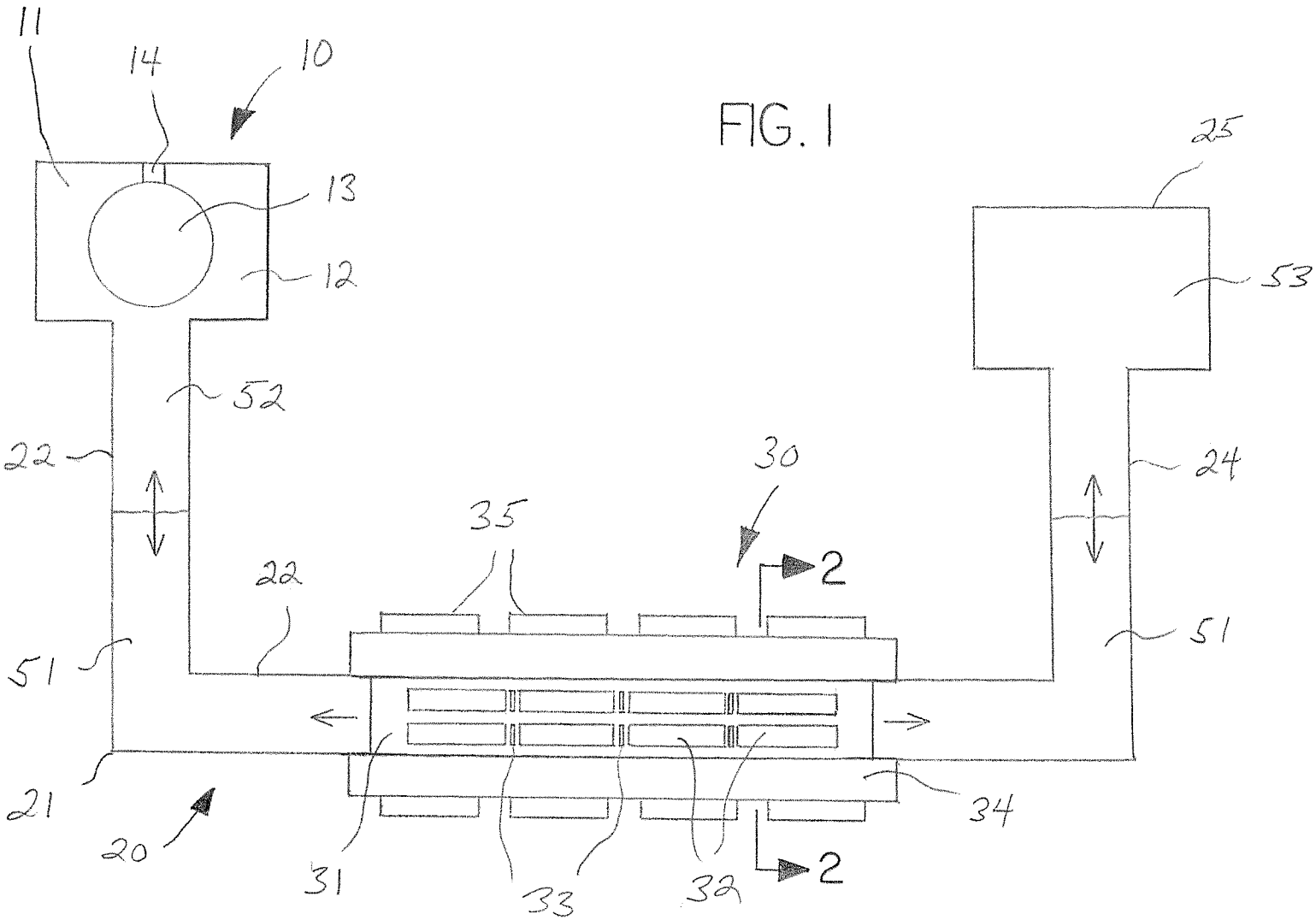
FIG. 1 a schematic representational view of an embodiment of the invention.

In various embodiments the invention comprises in general a liquid piston Stirling engine electrical generator, the generator being a linearly reciprocating electrical generator that is powered by a Stirling engine having a liquid, referred to as a liquid piston, that is displaced by the cyclic expansion and contraction/compression in volume of a gas, such as air, as illustrated in FIG. 1.

The liquid piston 51 and dynamic components of the linear generator 30 are retained within a liquid piston assembly 20 comprising a U-shaped tube or chamber 21, the chamber 21 being oriented in use to consist of a two upwardly extending, first and second vertical segments 23 and 24 connected to a linear horizontal segment 22, the combination providing a continuous opening to receive a quantity of an essentially non-compressible liquid, such as water, oil or hydraulic fluid, which defines the liquid piston 51 and which is present in sufficient quantity to fill the horizontal segment 22 and extend upward into the vertical segments 23/24 of the U-shaped chamber 21. In this manner the U-shaped chamber 21 acts as a trap to preclude movement of gas into and through the horizontal segment. The gas is present as a first volume gas 52 and a second volume gas 53. The first volume gas 52 resides in the first vertical segment 23 and cycle head 10. The second volume gas 53 resides in the second vertical segment 24 and the gas spring chamber 25. The first volume gas 52 and a second volume gas 53 may be identical or may differ in composition.

The cycle head 10 of the Stirling engine is located on the upper end of the first vertical segment 23 and retains the first volume of gas 52, the cycle head 10 comprising a hot side heat exchanger 11 structured to transfer heat energy to a gas of lower temperature occupying open areas within the hot side heat exchanger 11, a cold side heat exchanger 12 structured to remove or receive energy from a gas of higher temperature occupying open areas within the cold side heat exchanger 12, a displacer 13 adapted to move the first volume of gas 52 between the hot and cold side heat exchangers 11/12, a thermal barrier 14 between the hot and cold side heat exchangers 11/12, and a motor (not shown) to move the displacer 13. Stirling engines are well known. The displacer 13 may be of various known types, such as for example be a rotary displacer or a piston displacer. With cycle heads 10 comprising a rotary displacer 13, the rotary displacer 13 in a preferred embodiment is of the type having semi-circular blades mounted onto a rotatable shaft. As the blades are rotated they pass through open sub-chambers or voids defined by fins in the hot and cold side heat exchangers 11/12, the movement of the blades displacing hot or cool air from the sub-chambers in cycling manner as needed. A rotary displacer 13 is preferred over a piston displacer 13, as the large number of blades on the displacer 13 and the fins formed in the hot and cold side heat exchangers 11/12 increase the surface area available for heat exchange. The displacer 13 is motor operated, such as by an electrical motor which rotates the displacer shaft.

A high-pressure gas spring chamber 25 is located at the upper end of the second vertical segment 24 of the U-shaped chamber 21 and retains the second volume of gas 53, the chamber 25 acting as a gas spring against the liquid piston 51, the combination of the cycle head 10 and the gas spring chamber 25 producing reciprocating movement of the liquid piston 51 within the U-shaped chamber 21 as the first volume of gas 52 expands and contracts and the second volume of gas 53 is compressed and then expands.

The linear generator 30 comprises the combination of dynamic components and static components. The dynamic components comprise a horizontally translating or reciprocating slider 31 on which are mounted permanent magnets 32, the slider 31 being configured and sized in transverse cross-section to correspond to the configuration and size of the interior of horizontal segment 22 of the U-shaped chamber 21, effectively acting in the manner of a moving plug which reciprocates linearly within the horizontal segment 22 of the U-shaped chamber 21 as the liquid piston 51 moves in reciprocating manner. Mounted onto, encircling or formed as or from an integral component of the horizontal segment 22 is a static stator 34 having annular wire coils 35 encircling the horizontal segment 22.

Figure 2:
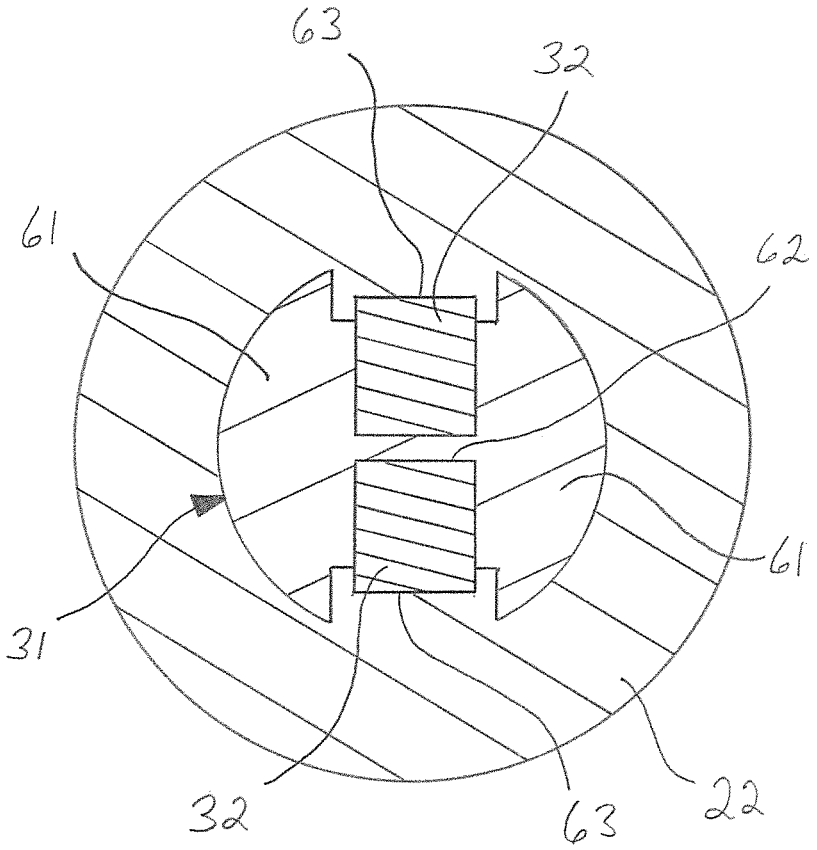
FIG. 2 is a cross-sectional view of the horizontal segment of the embodiment of FIG. 1 taken along line 2-2, the view showing the stator, slider and magnets mounted in channels on the slider.

Preferably, the slider 31 is configured to comprise a thin bridging member 62 extending between two lobes 61, the combination defining a pair of longitudinal channels 63, as shown in FIG. 2. The magnets 32 are paired vertically, separated by the bridging member 62 of the slider and occupying the longitudinal channels 63. With more than two magnets 32, the magnets 32 are separated horizontally by spacers 33. The magnet pairs 32 are oriented such that the like poles point in the same direction, for example both N poles on top and both S poles on the bottom.

The static components of the linear generator 30 comprise a stator 34 having wire coils 35 annularly disposed thereon, the wire coils 35 encircling a portion of the horizontal segment 22 of the U-shaped chamber 21. The stator 34 may be a separately defined component encircling all of a portion of the horizontal segment 22 of the U-shaped chamber 21, or the stator 34 may be defined by, formed integrally with or constitute all or a portion of the horizontal segment 22.

The external configuration of the slider 31 and the internal configuration of the horizontal segment 22 or the stator 34 in transverse cross-section are preferably designed such that movement of the slider 31 in any direction other than along the longitudinal axis, i.e., rotational movement, is precluded, and further such that only a minimum gap necessary to allow for movement is present. In this manner the slider 31 easily reciprocates in response to movement of the liquid piston 51, which also serves to provide lubrication between the slider 31 and the interior wall of the horizontal segment 22. With this structure, reciprocating linear movement of the slider 31 within the stator 34 generates an electrical current as the magnets 32 oscillate within the coils 35. Electrical current produced by the linear generator 30 is delivered for use or battery storage in known manner.

The liquid comprising the liquid piston 51 is present on both sides of the dynamic slider 31, fills the horizontal segment 22 and extends partially up each of the first and second vertical segments 23/24, thereby creating a lower seal for the first volume gas 52 within the first vertical segment 23 of the U-shaped chamber 21 and a lower seal for the second volume gas 53 within the second vertical segment 24. The movement of the slider 31 is caused by the expansion and contraction cycling of the first volume gas 52 by the cycle head 10 combined with the compression and expansion cycling, in opposite sequence, of the second volume gas 53 within the gas spring chamber 25.

In operation, the hot side heat exchanger 11 of the cycle head 10 receives heat energy from an external source. With the displacer 13 positioned so as to occupy the open volume of the cold side heat exchanger 12, the first volume gas 52 present in the cycle head 10 is in contact with the surface of the hot side heat exchanger 11 and expands as it absorbs heat from the hot side heat exchanger 11. This expanded gas 52 presses against and lowers the portion of the liquid piston 51 present in the first vertical segment 23 of the U-shaped chamber 21. The liquid piston 51, being non-compressible, then presses against the end of the slider 31 and shifts it in the direction of the second vertical segment 24, thereby moving the magnets 32 in the longitudinal axial direction relative to the coils 35 of the stator 34. The movement of the slider 31 forces the portion of the liquid piston 51 present in the second vertical segment 24 upward, thereby compressing the second volume gas 53 within the gas spring chamber 25. Once pressure is equalized, the displacer 13 is then moved from the cold side heat exchanger 12 to occupy the open volume of the hot side heat exchanger 11, thereby allowing the first volume gas 52 to contact the surface of the cold side heat exchanger 12. The heat energy present in the first volume gas 52 is now transferred to the cold side heat exchanger 12, acting as heat sink, thereby lowering the temperature and reducing the volume of the first volume gas 52 as well as the pressure being applied to the liquid piston 51 present in the first vertical segment 23. The compressed second volume gas 53 in the gas spring chamber 25 is then able to expand, moving the liquid piston 51 in the second vertical segment 24 downward to press against the slider 31, thereby forcing the slider 31 back in the direction of the first vertical segment 23, which moves the magnets 32 in the opposite direction relative to the wire coils 35. The movement of the slider 31 in this direction forces the liquid piston 51 in the first vertical segment 23 upward, the now cooler first volume gas 52 in the cold side heat exchanger 12 having a reduced volume. Once pressure is equalized, the displacer 13 than is then moved back to occupy the open volume of the cold side heat exchanger 12, shifting the cooled first volume gas 52 back to the hot side heat exchanger 11. This cycle is then continuously repeated to produce reciprocal movement of the slider 31 within the stator 34 and generate electricity.

The liquid piston Stirling engine linear generator as described provides a simple design with very high gas pressures and low friction, thereby keeping manufacturing and operational costs low. The rotary displacer 13 operates with very low energy, as it can be operated by an electric motor, and allows for heat regeneration as well as being highly efficient in displacing the first volume gas 52. Because of the liquid piston 51, only static seals are required for the device, as there is no requirement for seals to be in contact with the dynamic slider 31. The device produces high AC power output and maintains low operational temperatures.

It is understood that equivalents and substitutions for certain elements set forth above may be obvious to those of skill in the art, and therefore the true scope and definition of the invention is to be as set forth in the following claims.

I claim:

1. A liquid piston Stirling engine linear generator device comprising:

a U-shaped chamber having a first vertical segment and a second vertical segment joined by a horizontal segment;

a liquid piston comprising a liquid occupying said horizontal segment, a portion of said first vertical segment and a portion of said second vertical segment;

a cycle head of a Stirling engine connected to and in fluid communication with said first vertical segment;

a gas spring chamber connected to and in fluid communication with said second vertical segment;

a first volume gas occupying said cycle head and in contact with said liquid occupying said first vertical segment, and a second volume gas occupying said gas spring chamber and in contact with said liquid occupying said second vertical segment;

a slider disposed within said horizontal segment, said slider able to move in reciprocating manner within said horizontal segment;

magnets disposed on said slider; and a stator comprising wire coils annularly encircling said horizontal segment;

whereby expansion and contraction of said first volume gas upon operation of said cycle head results in reciprocal movement of said slider relative to said wire coils such that electrical current is generated.

2. The device of claim 1, said slider having a transverse cross-sectional configuration and said horizontal segment having a transverse cross-sectional configuration, wherein said slider transverse cross-sectional configuration corresponds to said horizontal segment transverse cross-sectional configuration.

3. The device of claim 2, wherein said slider transverse cross-sectional configuration and said horizontal segment transverse cross-sectional configuration preclude rotational movement of said slider within said horizontal segment.

4. The device of claim 3, wherein said slider comprises a bridging member connecting two lobes to form a pair of channels, and wherein said magnets are disposed within said channels.

5. The device of claim 1, wherein said liquid is chosen from the group of liquids consisting of hydraulic fluid and oil.

6. The device of claim 1, wherein said cycle head comprises a rotary displacer.

7. The device of claim 1, wherein said slider is disposed within said liquid piston.

8. The device of claim 1, wherein said stator is disposed on said horizontal segment.

9. The device of claim 1, wherein said stator is comprised of a portion of said horizontal segment.

10. A liquid piston Stirling engine linear generator device comprising:

a U-shaped chamber having a first vertical segment and a second vertical segment joined by a horizontal segment, said U-shaped chamber structured to retain a liquid;

a liquid piston comprising an essentially non-compressible liquid occupying said horizontal segment, a portion of said first vertical segment and a portion of said second vertical segment;

a cycle head of a Stirling engine connected to and in fluid communication with said first vertical segment, said cycle head comprising a hot side heat exchanger, a cold side heat exchanger and a displacer;

a gas spring chamber connected to and in fluid communication with said second vertical segment;

a first volume gas occupying said cycle head and in contact with said liquid occupying said first vertical segment, and a second volume gas occupying said gas spring chamber and in contact with said liquid occupying said second vertical segment;

a slider disposed within said horizontal segment and within said liquid piston, said slider retaining magnets and able to move in reciprocating manner within said horizontal segment; and a stator disposed on or formed as part of said horizontal segment, said stator comprising wire coils annularly encircling said horizontal segment and surrounding said slider;

said slider having a transverse cross-sectional configuration and said horizontal segment having a transverse cross-sectional configuration, wherein said slider transverse cross-sectional configuration corresponds to said horizontal segment transverse cross-sectional configuration;

whereby expansion and contraction of said first volume gas upon operation of said cycle head results in reciprocal movement of said liquid piston within said U-shaped chamber and reciprocal movement of said slider relative to said wire coils such that electrical current is generated.

11. The device of claim 10, wherein said slider transverse cross-sectional configuration and said horizontal segment transverse cross-sectional configuration preclude rotational movement of said slider within said horizontal segment.

12. The device of claim 11, wherein said slider comprises a bridging member connecting two lobes to form a pair of channels, and wherein said magnets are disposed within said channels.

13. The device of claim 10, wherein said liquid is chosen from the group of liquids consisting of hydraulic fluid and oil.

14. The device of claim 10, wherein said cycle head comprises a rotary displacer.

15. The device of claim 10, wherein said stator is disposed on said horizontal segment.

16. The device of claim 10, wherein said stator is comprised of a portion of said horizontal segment.

* * * * *